US007439926B2

(12) United States Patent
Mikami et al.

(10) Patent No.: US 7,439,926 B2
(45) Date of Patent: Oct. 21, 2008

(54) PLANAR ANTENNA FITTED WITH A REFLECTOR

(75) Inventors: Koichi Mikami, Warabi (JP); Noboru Matsuoka, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 97 days.

(21) Appl. No.: 10/530,135

(22) PCT Filed: Jun. 22, 2004

(86) PCT No.: PCT/JP2004/008749

§ 371 (c)(1),
(2), (4) Date: Apr. 4, 2005

(87) PCT Pub. No.: WO2005/013422

PCT Pub. Date: Feb. 10, 2005

(65) Prior Publication Data

US 2006/0238432 A1 Oct. 26, 2006

(30) Foreign Application Priority Data

Aug. 5, 2003 (JP) ..... 2003-286502
May 21, 2004 (JP) ..... 2004-151456

(51) Int. Cl.
*H01Q 1/42* (2006.01)
*H01Q 21/00* (2006.01)

(52) U.S. Cl. ..... 343/789; 343/867

(58) Field of Classification Search ..... 343/789, 343/792.5, 866, 867
See application file for complete search history.

(56) References Cited

U.S. PATENT DOCUMENTS

| | | | | |
|---|---|---|---|---|
| 3,568,206 | A | 3/1971 | Sisson | |
| 5,583,523 | A | 12/1996 | Wallace | |
| 5,714,937 | A | 2/1998 | Campana | |
| 5,969,687 | A * | 10/1999 | Podger | 343/742 |
| 6,281,856 | B1 | 8/2001 | Tang et al. | |
| 6,281,858 | B1 | 8/2001 | Jennetti | |
| 6,525,694 | B2 * | 2/2003 | Jiang et al. | 343/742 |
| 6,606,067 | B2 * | 8/2003 | Oh et al. | 343/741 |
| 2002/0050954 | A1 | 5/2002 | Oh | |

FOREIGN PATENT DOCUMENTS

| | | |
|---|---|---|
| EP | 0751581 A1 | 1/1997 |
| EP | 1 102 349 | 5/2001 |
| JP | 63-138803 | 6/1988 |
| JP | 04-048282 | 2/1992 |
| JP | 06-053735 | 2/1994 |
| JP | 06268432 | 9/1994 |
| JP | 10-022721 | 1/1998 |
| JP | 2001-196838 | 7/2001 |
| JP | 2002-135031 | 5/2002 |

* cited by examiner

*Primary Examiner*—Shih-Chao Chen
(74) *Attorney, Agent, or Firm*—Kirk Hahn

(57) ABSTRACT

A planar antenna fitted with a reflector of small shape and small depth. A reflector 21 of planar shape is provided at the rear face of a radiator 20 of planar shape made of a triangular loop element. The side sections 21*b* on both sides of the reflector 21 are bent towards the radiator 20 and the separation .alpha.2 between the leading edges of the side sections 21*b* and the side edges of the radiator 20 is thereby reduced. In this way, an excellent electrical characteristic of the planar antenna 2 fitted with a reflector and can be achieved by reducing the separation D2 of the radiator 20 and reflector 21.

12 Claims, 16 Drawing Sheets

| D2 | L13 | α2 | DEGREE OF IMPROVEMENT (GRAPH READOUT VALUE OF VSWR) | | REMARKS |
|---|---|---|---|---|---|
| | | | FREQUENCY OF IMPROVEMENT[MHz] | MAXIMUM IMPROVEMENT VALUE | |
| 30 | 30 | 10 | 470～620 | 1.8(470MHz) | |
| | | 30 | 470～620 | 1.0(470MHz) | |
| 40 | 30 | 10 | 470～590 | 1.9(470MHz) | FIG.12 |
| | | 30 | 470～590 | 0.9(470MHz) | FIG.16 |
| | 40 | 10 | 470～560 | 2.6(470MHz) | FIG.10 |
| | | 30 | 470～590 | 1.2(470MHz) | FIG.14 |
| | 70 | 10 | 470～560 | 2.7(470MHz) | |
| | | 30 | 470～590 | 1.7(470MHz) | |
| 70 | 70 | 10 | 470 | 0.5(470MHz) | |
| | | 30 | 470 | 0.5(470MHz) | |

PLANAR ANTENNA FITTED WITH A REFLECTOR

TECHNICAL FIELD

The present invention relates to a double loop antenna having a reflector capable of operation in the UHF band and in particular relates to a planar antenna fitted with a reflector that is suitable as a UHF antenna for receiving terrestrial digital broadcasts in the UHF frequency band.

BACKGROUND ART

In contrast to conventional analogue broadcasts, with terrestrial digital broadcasts, a sharp image can be obtained even if the incoming electromagnetic waves are received with more than a fixed level, since they constitute digital signals. An antenna for receiving terrestrial digital broadcasts therefore does not necessarily need to be of high gain. It may therefore be expected that this will make it possible to design antennas that are of smaller size and of a shape that is more easily handled than that of conventional antennas. As conventional UHF television antennas that are capable of operating in the UHF band, antennas are known whose principles of operation are based on Yagi/Uda antennas and in which a transmission element and reflector are arranged. In such antennas, the separation between the transmission element and reflector is usually about $\lambda/4$, where $\lambda$ is the wavelength of the central frequency of the operating waveband. A known example of such an antenna is a skeleton slot array antenna (see non-patent reference 1).

Non-patent reference 1: Denshi Tsushin Gakkai Gijutsu Kenkyu Hokoku (Technical Research Reports of the Japanese Electronic Communication Association Vol. 87 No. 3A. P 87-5 Hiroyuki Nii and three others: Skeleton Slot Array Antenna for UHF-TV Reception (Apr. 16, 1987).

DISCLOSURE OF THE INVENTION

Problem that the Invention is Intended to Solve

However, in the case of a planar antenna fitted with a reflector as shown in non-patent reference 1, based on the principles of a Yagi/Uda antenna, the separation between the radiator and the reflector must be comparable with the frequency band, so, assuming that the UHF band is 470 to 770 MHz, since the wavelength at the central frequency of this band is about 484 mm, a separation of at least 100 mm or more is necessary. There was therefore the problem that the shape of the planar antenna fitted with a reflector had to be of large dimensions, with a large depth.

An object of the present invention is therefore to provide a planar antenna fitted with a reflector having a shape which is of small dimensions, with a small depth.

Means for Solving the Problem

In order to achieve the above object, the most important characteristic of a planar antenna fitted with a reflector according to the present invention is that it comprises a radiator and a reflector of planar form whereof both side sections, arranged with a prescribed separation from this radiator, are bent towards the side of the radiator, this prescribed separation being reduced to about 0.06 $\lambda$, where $\lambda$ is the wavelength of the central frequency of the operating frequency band.

Effect of the Invention

Since, according to the present invention, the separation of the radiator and the reflector is reduced to about 0.06 $\lambda$, a planar antenna fitted with a reflector that is of small size and small depth can be achieved. Also, even though the planar antenna fitted with a reflector is of small size and small depth, since both side sections of the reflector are bent towards the radiator, its leading edges are adjacent to the radiator, so an antenna can be achieved that operates fully satisfactorily in the frequency band of terrestrial digital broadcasting i.e. the UHF band.

EXPLANATION OF THE REFERENCE SYMBOLS

1 planar antenna fitted with a reflector, 2 planar antenna fitted with a reflector, 3 planar antenna fitted with a reflector, 4 planar antenna fitted with a reflector, 5 planar antenna fitted with a reflector, 6 planar antenna fitted with a reflector, 10 radiator, 10*a* power feed point, 10*b* right hand side, 10*c* left-hand side, 10*d* upper side, 10*e* lower side, 10*f* middle side, 11 reflector, 11*a* front face section, 11*b* side section, 20 radiator, 20*a* power feed point, 20*b* inclined side, 20*c* inclined side, 20*d* upper side, 20*e* lower side, 20*f* inclined side, 20*g* inclined side, 21 reflector, 21*a* front face section, 21*b* side section, 30 biconical radiator, 30*a* power feed point, 31 reflector, 31*a* front face section, 31*b* side section, 40 loop radiator, 40*a* power feed point, 41 reflector, 41*a* front face section, 41*b* side section, 50 dipole radiator, 50*a* power feed point, 51 reflector, 51*a* front face section, 51*b* side section, 60 dipole radiator, 60*a* first dipole radiator, 60*b* power feed point, 60*c* second dipole radiator, 60*d* power feed point, 61 reflector, 61*a* front face section, 61*b* side section, 71 reflector, 71*a* front face section, 71*b* side section, 71*c* bent section, 81 reflector, 81*a* first bent section, 82*b* second bent section, 91 reflector, 91*a* front face section, 91*b* side section, 100 planar antenna fitted with a reflector, 110 radiator, 111 reflector, 200 planar antenna fitted with a reflector, 220 radiator, 221 reflector.

BEST MODE FOR CARRYING OUT THE INVENTION

The object of providing a planar antenna fitted with a reflector having a shape which is of small dimensions, with a small depth is achieved by providing a radiator and a reflector of planar form whereof both side sections, arranged with a prescribed separation from this radiator, are bent towards the side of the radiator, this prescribed separation being reduced to about 0.06 λ, where λ is the wavelength of the central frequency of the operating frequency band.

Embodiment 1

Figure 1:
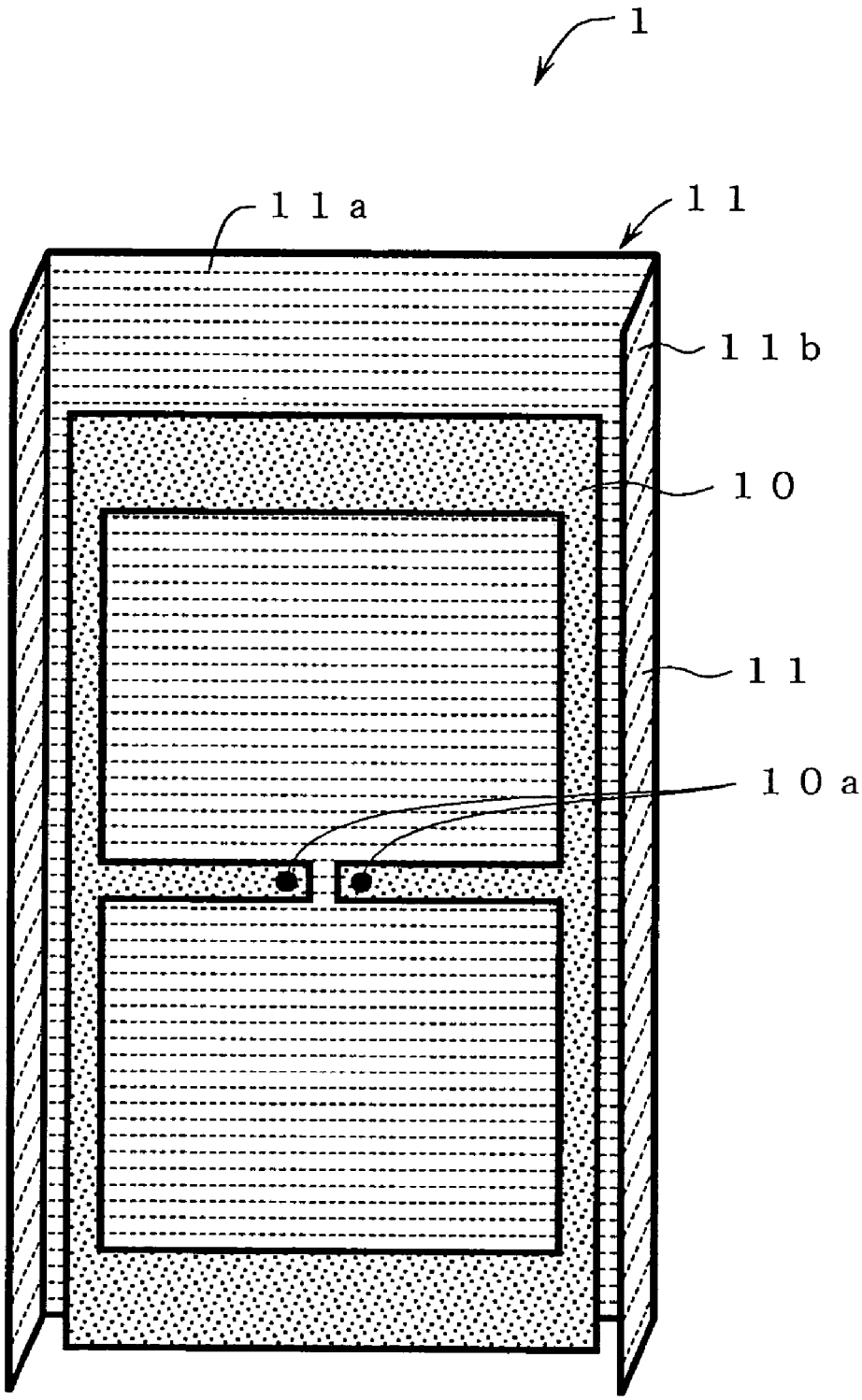
FIG. 1 is a perspective view showing the construction of embodiment 1 of a planar antenna fitted with a reflector according to the present invention.
Figure 2:
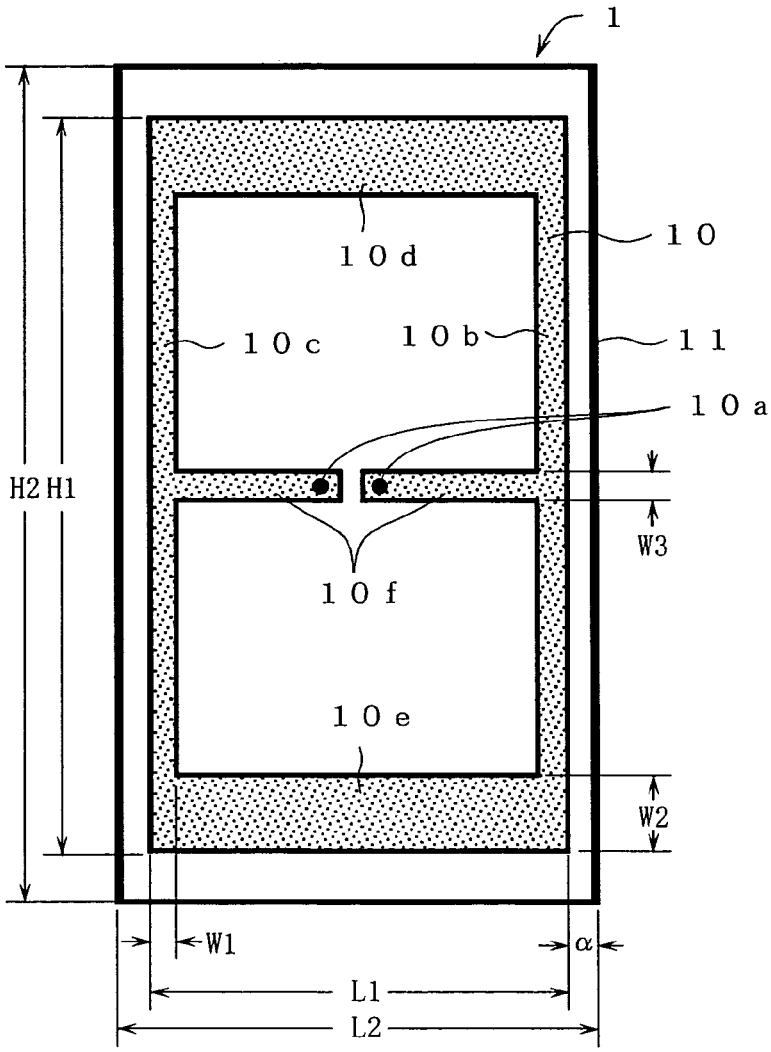
FIG. 2 is a plan view showing the construction of embodiment 1 of a planar antenna fitted with a reflector according to present invention.
Figure 3:
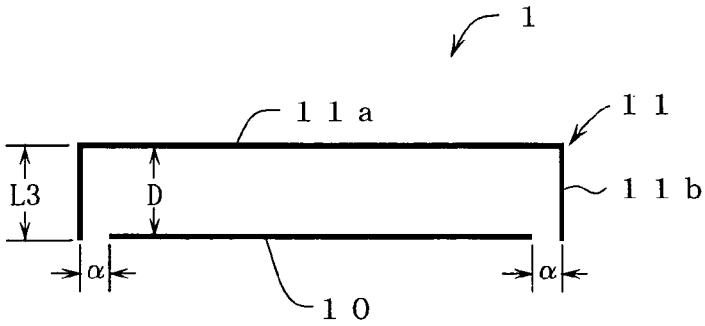
FIG. 3 is a top view showing the construction of embodiment 1 of a planar antenna fitted with a reflector according to the present invention.

The construction of embodiment 1 of the planar antenna fitted with a reflector according to the present invention is shown in FIG. 1 to FIG. 3. Specifically, FIG. 1 is a perspective view showing the construction of a planar antenna fitted with a reflector according to the present invention; FIG. 2 is a plan view showing the construction of a planar antenna fitted with a reflector according to the present invention; and FIG. 3 is a top view showing the construction of a planar antenna fitted with a reflector according to the present invention.

As shown in these Figures, the planar antenna 1 fitted with a reflector according to embodiment 1 of the present invention comprises a radiator 10 comprising a square double loop element and a reflector 11 arranged to the rear of and facing the radiator 10.

The radiator 10 is constructed of rectangular shape by processing a metal plate; as shown in FIG. 2, it comprises a right side 10*b*, a left side 10*c*, an upper side 10*d* and a lower side 10*e* constituting the outer frame of the rectangular shape and a middle side 10*f* formed in the transverse direction substantially in the center thereof. The middle of the middle side 10*f* is cut and the severed ends constitute power feed points 10*a*. In this radiator 10, a square double loop element is constituted comprising a first square loop element comprising the upper half of the left side 10*c*, the upper halves of the upper side 10*d* and right side 10*b* and the middle side 10*f* and a second square loop element comprising the bottom half of the right side of 10*b*, the bottom half of the lower side 10*e* and left side 10*c* and the middle side 10*f*.

The reflector 11 is formed by bending both sides of a rectangular metallic plate substantially at right-angles so as to face each other; as shown in FIG. 1 and FIG. 3, the reflector 11 comprises a front face section 11*a* facing the radiator 10 and side sections 11*b* formed by bending towards the radiator 10 on both sides of the front face section 11*a*.

In the planar antenna 1 fitted with a reflector according to the present invention constructed in this way, as shown in FIG. 2 and FIG. 3, the transverse width of the radiator 10 is represented by L1, its height by H1, the width of the right side 10*b* and left side 10*c* by W1, the width of the upper side 10*d* and lower side 10*e* by W2 and the width of the middle side 10*f* by W3; the height of the reflector 11 is represented by H2, the width of the front face section 11*a* by L2 and the width of the side sections 11*b* by L3; the separation between the radiator 10 and the front face section 11*a* in the reflector 11 is represented by D and the separation between the side edge of the radiator 10 and the end edge of the side sections 11*b* of the reflector 11 is represented by α. If the height H1 of the radiator 10 is about 280 mm, the width W1 is about 10 mm, the width W2 is about 30 mm, the width W3 is about 10 mm, and the height H2 of the reflector 11 is about 280 mm, the width L2 about 180 mm, the width L3 about 40 mm, and the separation D about 40 mm, a planar antenna 1 fitted with a reflector showing excellent electrical characteristics can be obtained if the separation α is made about 10 mm to about 30 mm.

Figure 4:
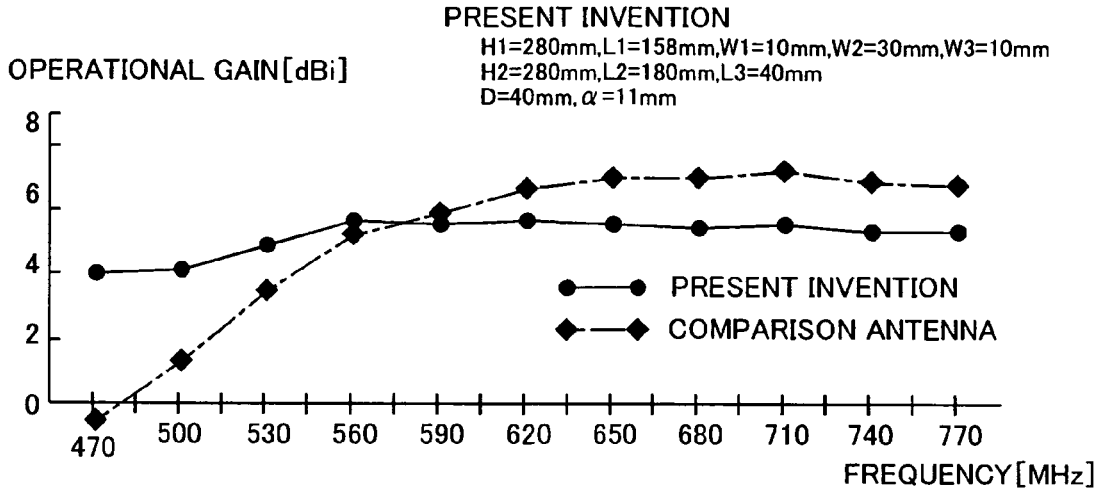
FIG. 4 is a view showing the frequency characteristic of the operational gain in the construction of embodiment 1 of a planar antenna fitted with a reflector according to the present invention, compared with a comparison antenna.
Figure 5:
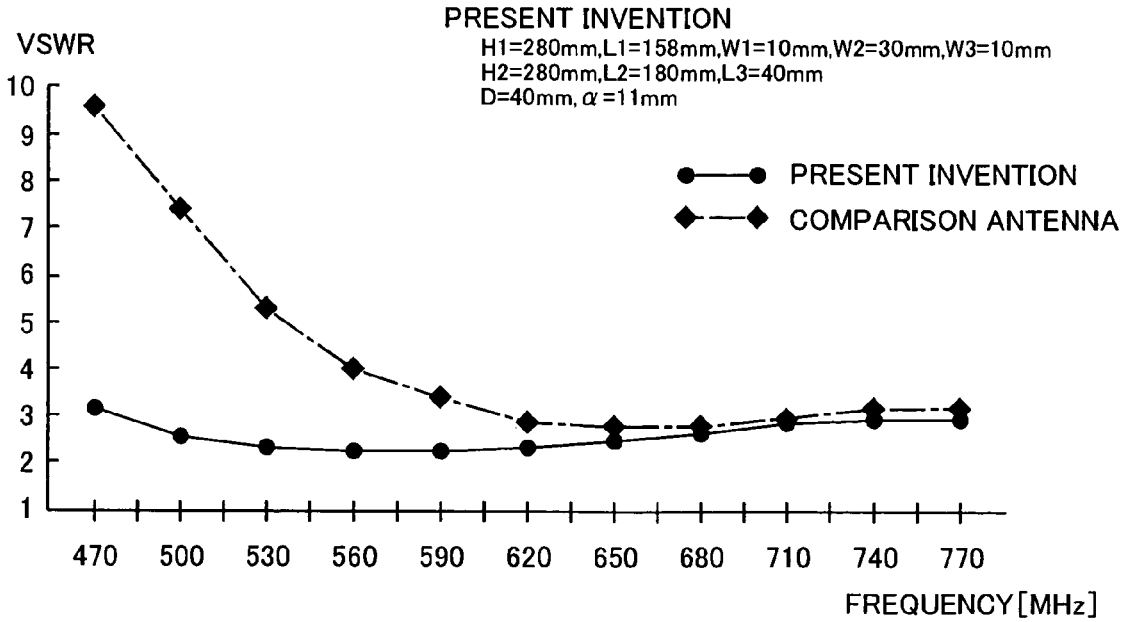
FIG. 5 is a view showing the VSWR frequency characteristic in the construction of embodiment 1 of a planar antenna fitted with a reflector according to the present invention, compared with a comparison antenna.

FIG. 4 shows the frequency characteristic of the operational gain of a planar antenna 1 fitted with a reflector when the separation α is about 11 mm; FIG. 5, by a curve plotted with black circles, indicated as "present invention" the frequency characteristic of the voltage standing wave ratio (VSWR). Referring to FIG. 4, it can be seen that an excellent operating gain characteristic of 4 dBi to 6 dBi can be obtained in the 470 MHz to 770 MHz frequency band of terrestrial digital broadcasting. Also, referring to FIG. 5, it can be seen that an excellent VSWR of no more than about 3 is obtained in the 470 MHz to 770 MHz frequency band of terrestrial digital broadcasting.

Also, the curves plotted with diamond symbols shown in FIG. 4 and FIG. 5 are the operating gain and VSWR frequency characteristics of a comparison antenna and are given in order to show the effect of the side sections 11*b* of the reflector 11 in the planar antenna 1 fitted with a reflector according to the present invention. Specifically, the comparison antenna is the planar antenna 100 fitted with a reflector shown in FIG. 6. In this planar antenna 100 fitted with a reflector, the reflector 111, which is of flat plate shape, not being bent at both sides, is arranged facing a radiator 110 comprising a square loop antenna. The radiator 110 is of the same construction as the radiator 10. Also, a separation of about 40 mm is taken for the separation d of the radiator 110 and the reflector 111; the other dimensions are the same in the case of the planar antenna 1 fitted with a reflector according to the present invention.

Figure 6:
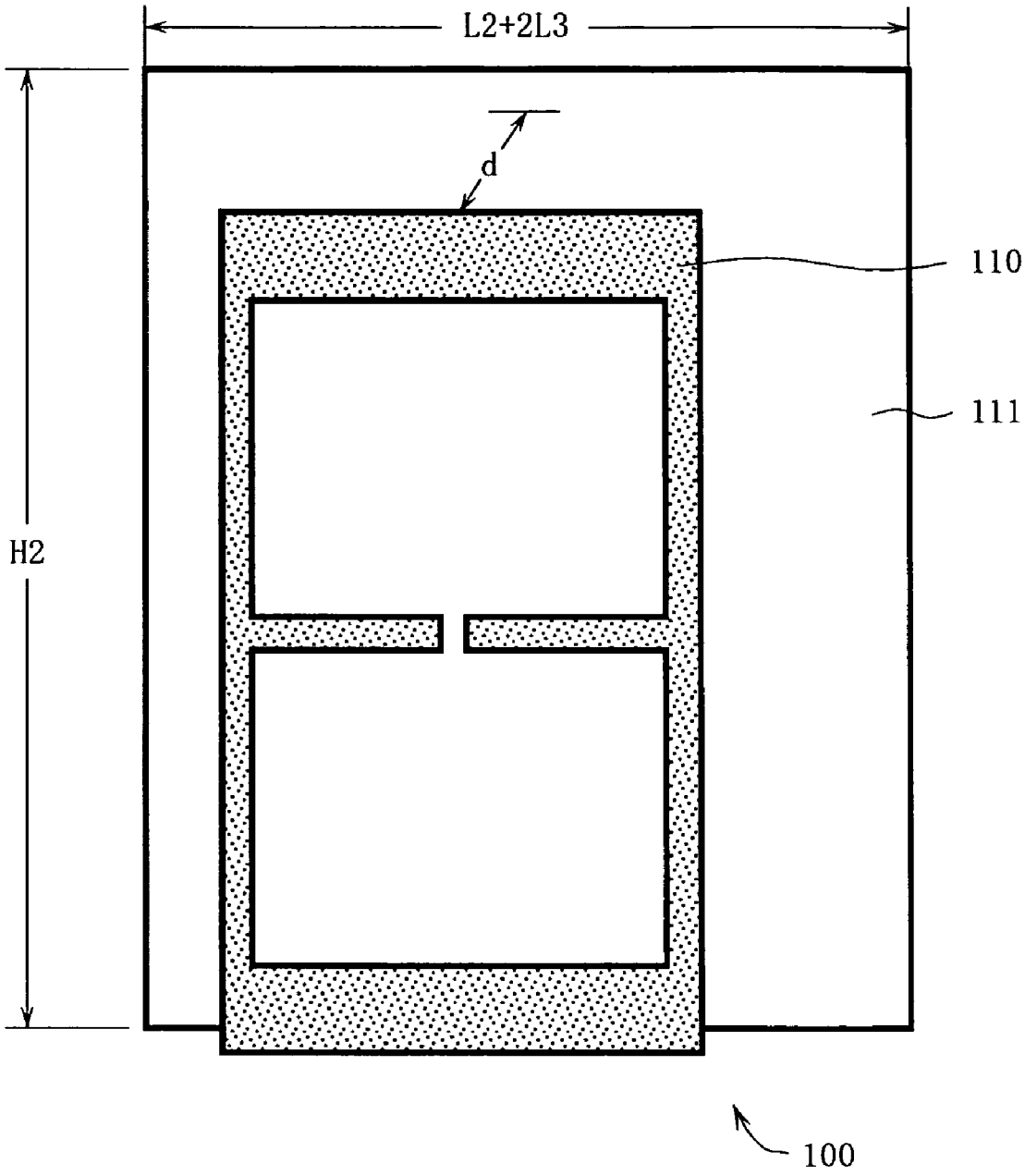
FIG. 6 is a view showing the construction of a planar antenna fitted with a reflector for comparison with a planar antenna fitted with a reflector according to the present invention.

Referring to FIG. 4, it can be seen that, in the case of the comparison antenna shown as the planar antenna 100 and fitted with a reflector in FIG. 6, the operating gain in the lower band in the terrestrial digital broadcast frequency band of 470 MHz to 770 MHz is lowered. Also, referring to FIG. 5, it can be seen that a VSWR that has deteriorated to 5 or more is produced in the low band of the terrestrial digital broadcast frequency band of 470 MHz to 770 MHz.

Comparing the electrical characteristic of the planar antenna 1 fitted with a reflector according to the present invention shown in FIG. 4 and FIG. 5 with the electrical characteristic of the planar antenna 100 fitted with a reflector in which the reflector 111 is not bent at both sides, as shown in FIG. 6, it can be seen that, if both sides of the reflector 11 are bent so as to provide side sections 11*b*, an excellent electrical characteristic is obtained in the low band at 470 MHz to 770 MHz i.e. the side sections 11*b* have the action of producing an excellent electrical characteristic in the low band at 470 MHz to 770 MHz. The reason why the electrical characteristic can be improved by such provision of side sections 11*b* is believed to be that, by providing the side sections 11*b*, the separation (α: see FIG. 3) between the side edges of the radiator 10 and the leading edges of the side sections 11*b* can be reduced, while maintaining the separation D of the radiator 10 and the reflector 11. Also, thanks to the large width W2 of the upper side 10*d* and lower side 10*e*, gain can be guaranteed in a wide frequency band of 470 MHz to 770 MHz. While the electrical characteristic tends to deteriorate as the separation D of the radiator 10 and the reflector 11 is decreased, a fully satisfactory electrical characteristic for a planar antenna 1 fitted with a reflector can be obtained if the separation between the radiator 10 and the reflector 11 is made about 30 mm.

The wavelength λc at the central frequency is about 484 mm, if the UHF band used to operate the planar antenna 1 fitted with a reflector according to the present invention is 470 to 770 MHz. The length of the outer periphery of the first square loop element and the second square loop element of the planar antenna 1 fitted with a reflector according to the present invention is about 0.93 λa for a wavelength λa of 470 MHz and the length of the inner periphery is about 1.2 λb for wavelength 770 MHz. Thus the length of the outer periphery of the square double loop element (radiator 10) of the planar antenna 1 fitted with a reflector is substantially the wavelength λa of the lower limiting frequency of the frequency band that is employed and the length of the inner periphery thereof is substantially the wavelength λb of the upper limiting frequency of the frequency band that is employed. Also, even if the height H2 of the reflector 11 is 0.86 H1 to 1.15 H1 of the height H1 of the radiator 10, an excellent electrical characteristic can be maintained. Furthermore, the separation D of the radiator 10 and the reflector 11 can be reduced to about 0.06 λc and the separation α of the side edges of the radiator 10 and the leading edges of the side sections 11*b* can be made less than the separation D, and the electrical characteristic of the planar antenna 1 fitted with a reflector is improved as the separation α is made smaller.

Embodiment 2

Figure 7:
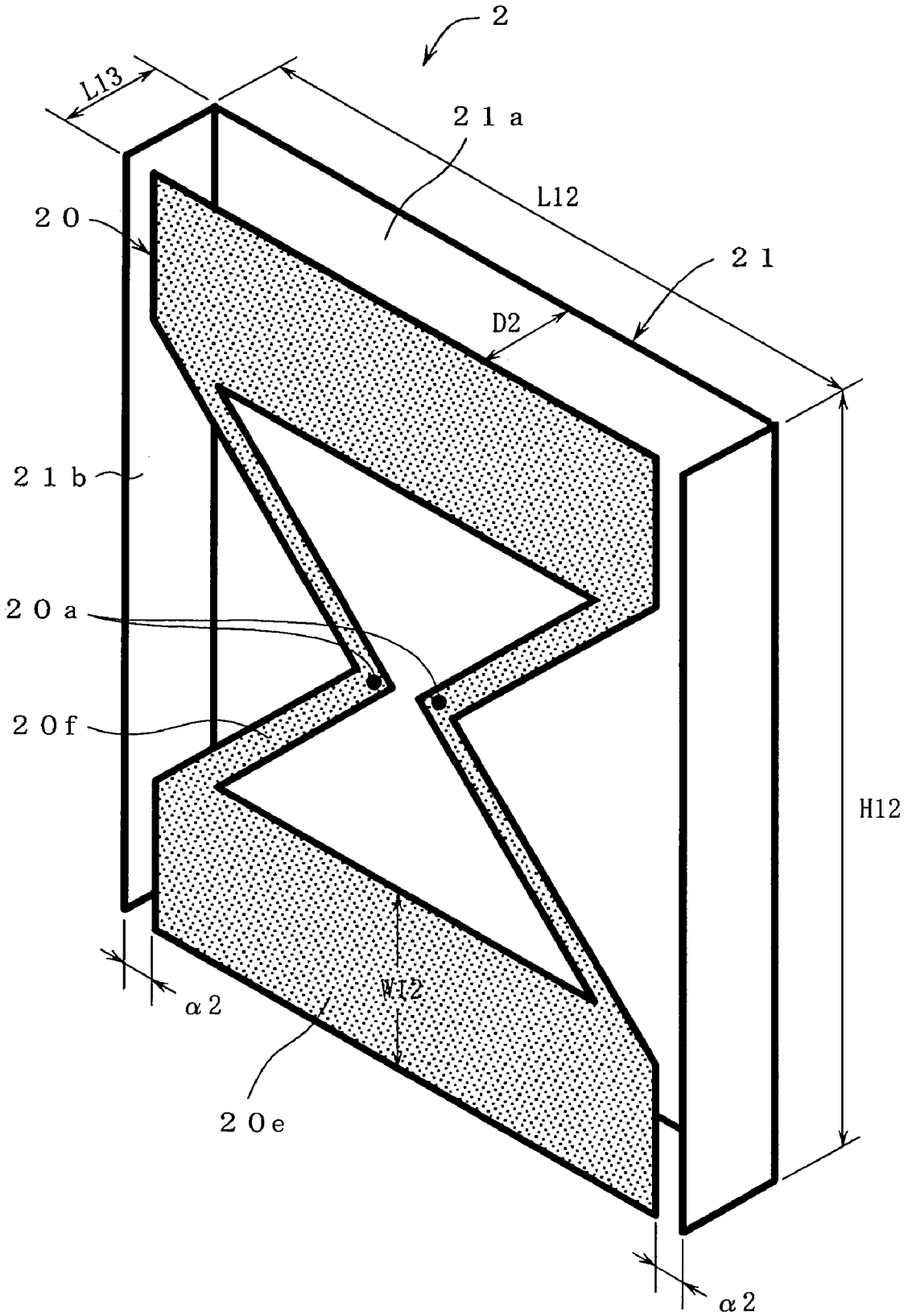
FIG. 7 is a perspective view showing the construction of embodiment 2 of a planar antenna fitted with a reflector according to the present invention.
Figure 8:
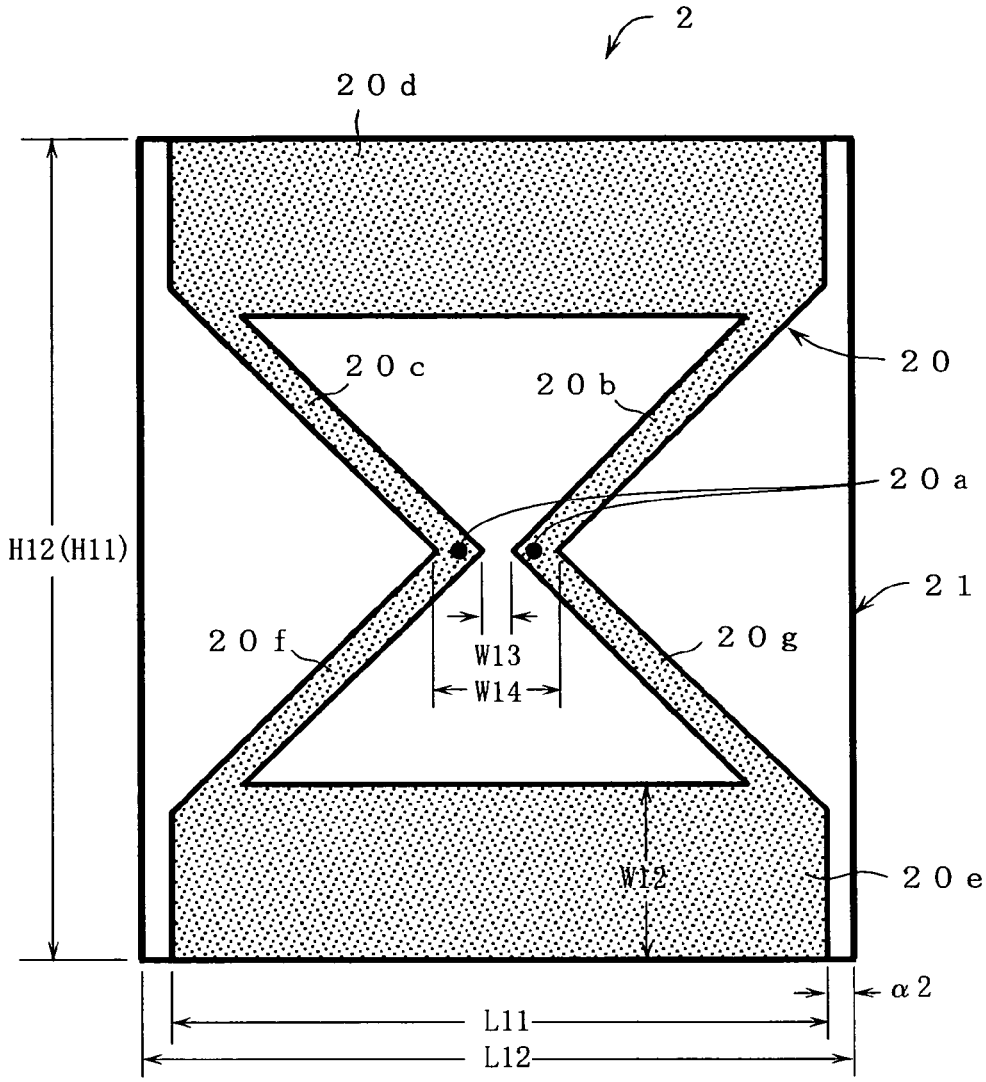
FIG. 8 is a plan view showing the construction of embodiment 2 of a planar antenna fitted with a reflector according to the present invention.
Figure 9:
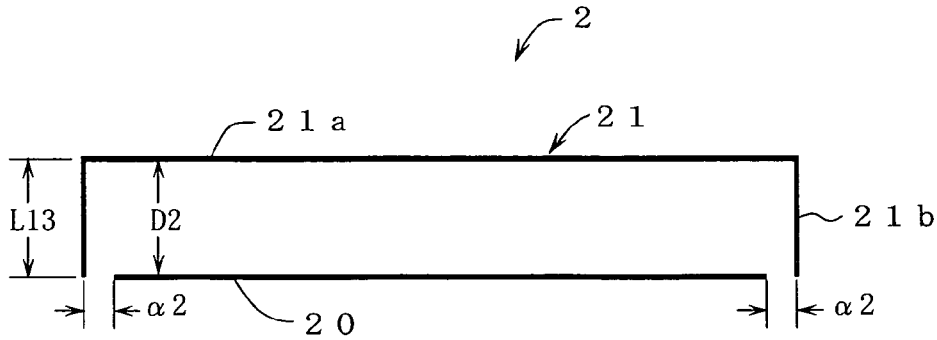
FIG. 9 is a top view showing the construction of embodiment 2 of a planar antenna fitted with a reflector according to the present invention.

The construction of embodiment 2 of the planar antenna fitted with a reflector according to the present invention is illustrated in FIG. 7 to FIG. 9. FIG. 7 is a perspective view showing the construction of a planar antenna fitted with a reflector according to the present invention; FIG. 8 is a plan view showing the construction of a planar antenna fitted with a reflector according to the present invention; and FIG. 9 is a top view showing the construction of a planar antenna fitted with a reflector according to the present invention.

As shown in these Figures, the planar antenna 2 fitted with a reflector according to embodiment 2 of the present invention comprises a radiator 20 comprising a triangular double loop element and a reflector 21 arranged to the rear thereof facing the radiator 20.

The radiator 20 is constructed of flat plate shape by processing a metal plate; as shown in FIG. 8, it comprises inclined sides 20*b*, 20*c*, 20*f*, 20*g*, upper side 20*d* and lower side 20*e* constituting a triangular outer frame. Power feed points 20*a* are constituted by the junction of the inclined side 20*b* and inclined side 20*g* and the junction of the inclined side 20*c* and inclined side 20*f*. This radiator 20 is a triangular double loop element comprising a first triangular loop element comprising the inclined side 20*c*, upper side 20*d* and inclined side 20*b* and a second triangular loop element comprising the inclined side 20*f*, lower side 20*e* and inclined side 20*g*.

The reflector 21 is formed by bending both sides of a rectangular metallic plate substantially at right angles so as to face each other; as shown in FIG. 7 and FIG. 9, it comprises a front face section 21*a* facing the radiator 20 and side sections 21*b* formed by bending on both sides of the front face section 21*a* towards the radiator 20.

In the planar antenna 2 fitted with a reflector according to the present invention constructed in this way, as shown in FIG. 8 and FIG. 9, the transverse width of the radiator 20 is L11, its height is H11, the width of the upper side 20*d* and lower side 20*e* is W12, the inside width of the joint of the inclined side 20*b* and inclined side 20*g* and the joint of the inclined side 20*c* and inclined side 20*f* is W13, and the outside width is W14; the height of the reflector 21 is H12, the width of the front face section 21*a* is L12, the width of the side plate is L13, the separation of the radiator 20 and front face section 21*a* in the reflector 21 is D2 and the separation of the side edge of the radiator 20 and of the side section 21*b* of the reflector 21 is α2.

Figure 10:
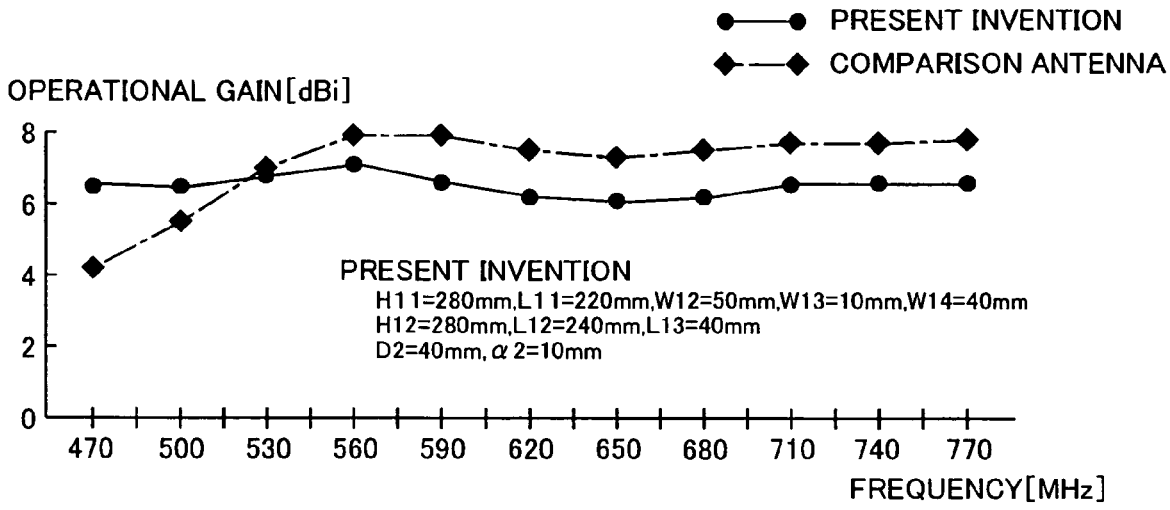
FIG. 10 is a view showing the frequency characteristic of the operational gain in the construction of embodiment 2 of a planar antenna fitted with a reflector according to the present invention, compared with a comparison antenna.
Figure 11:
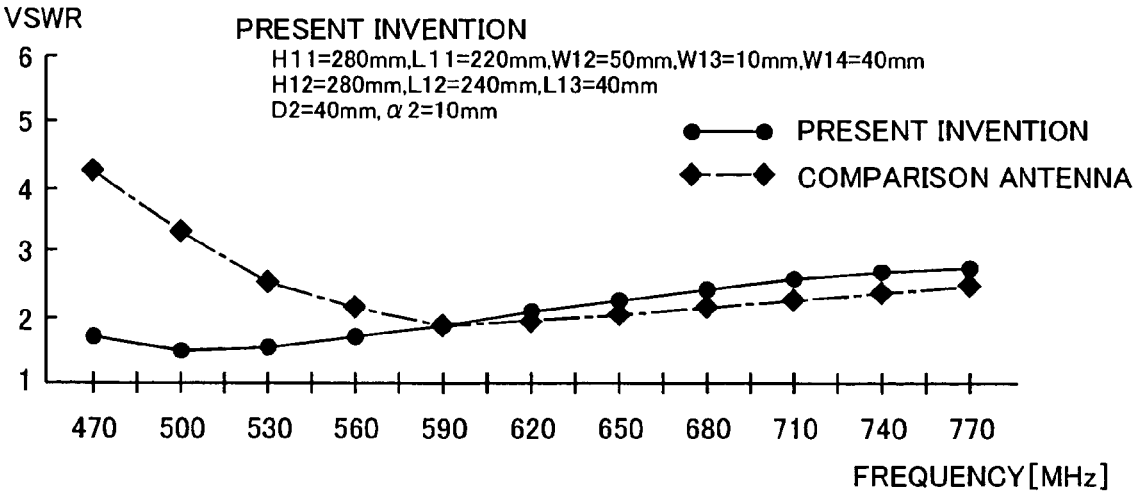
FIG. 11 is a view showing the VSWR frequency characteristic in the construction of embodiment 2 of a planar antenna fitted with a reflector according to the present invention, compared with a comparison antenna.

The frequency characteristic of the operating gain of the planar antenna 2 fitted with a reflector is shown plotted with black circles in FIG. 10 and the frequency characteristic of the voltage standing wave ratio is shown plotted with black circles as "present invention" in FIG. 11; the height H11 of the radiator 20 is about 280 mm, the transverse width L11 is 220 mm, the width W12 is about 50 mm, the width W13 is about 10 mm, the width W14 is about 40 mm and the height H12 of the reflector 21 is about 280 mm, its width L12 about 240 mm, the width L13 about 40 mm, the separation D2 about 40 mm and the separation α2 about 10 mm. Referring to FIG. 10, it can be seen that an excellent operating gain characteristic of that least 6 dBi is obtained over the terrestrial digital broadcast frequency band 470 MHz to 770 MHz. Also, referring to FIG. 11, it can be seen that an excellent VSWR of no more than about 3 is obtained in a 470 MHz to 770 MHz, which is the terrestrial digital broadcast frequency band.

Also, the curves plotted with diamonds shown in FIG. 10 and FIG. 11 are the frequency characteristics of the operational gain and VSWR of a comparison antenna, provided merely in order to demonstrate the effect of the reflector 21 and side sections 21*b* in the planar antenna 2 fitted with a reflector according to the present invention. Specifically, the comparison antenna is denoted as the planar antenna 200 fitted with a reflector shown in FIG. 18. In this planar antenna 200 fitted with a reflector, the reflector 221, which is of flat plate shape with sides that are not bent, is arranged facing the radiator 220, which comprises a triangular double loop element. The radiator 220 is of the same construction as the radiator 20. Also, the separation d2 between the radiator 220 and the reflector 221 is about 40 mm and the other dimensions are made the same as in the case of the planar antenna 2 fitted with a reflector according to the present invention.

Figures 18, 19:
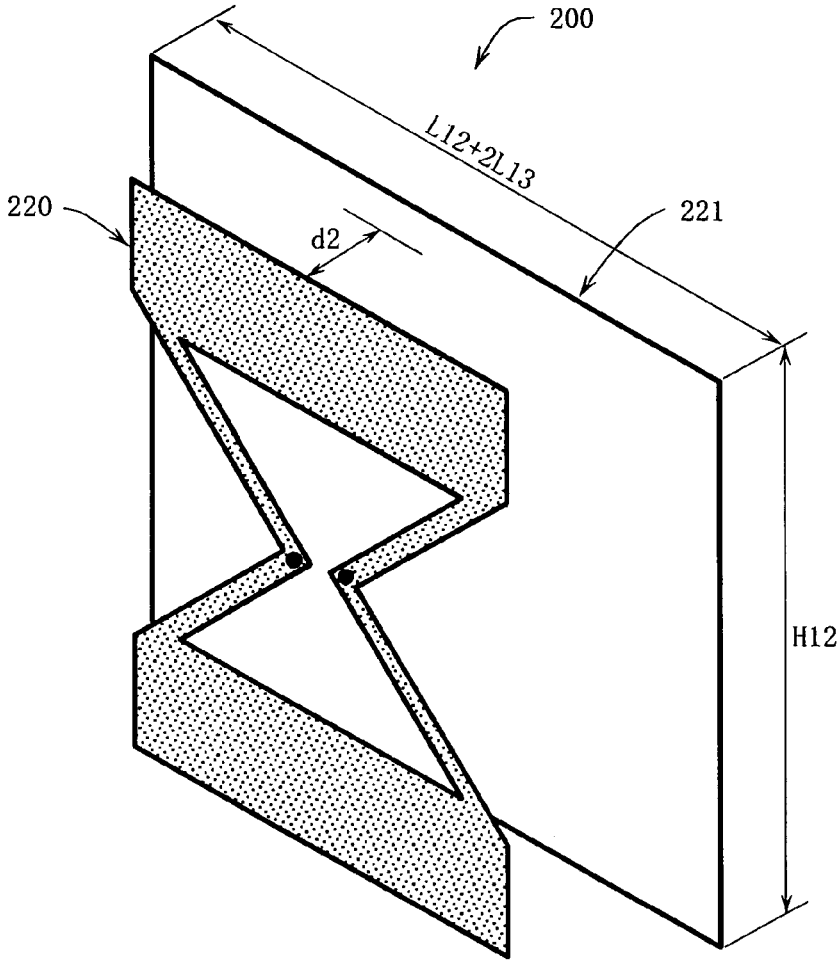
FIG. 18 is a view showing the construction of a planar antenna fitted with a reflector for comparison with a planar antenna fitted with a reflector according to the present invention.
FIG. 19 is a table showing the degree of improvement when the parameters of a planar antenna fitted with a reflector according to embodiment 2 of the present invention are varied.

Referring to FIG. 10, the transverse width of the comparison antenna shown as the planar antenna 200 fitted with a reflector is 320 mm, which is the width when the reflector 21 has not been bent in FIG. 18; it can be seen that the operational gain in the low band in 470 MHz to 770 MHz, which is the terrestrial digital broadcast frequency band, has dropped. Also, referring to FIG. 11, it can be seen that the VSWR in the low band in 470 MHz to 770 MHz, which is the terrestrial digital broadcast frequency band, has deteriorated.

Comparing the electrical characteristic of the planar antenna 2 fitted with a reflector according to the present invention shown in FIG. 10 and FIG. 11 with the electrical characteristic of the planar antenna 200 fitted with a reflector in which the two sides of the reflector 221 are not bent, shown in FIG. 18, it can be understood that the electrical characteristic of the low band in 470 MHz to 770 MHz when side sections 21*b* are provided by bending on both sides of the reflector 21 is excellent, so the side sections 21*b* have the effect of providing an excellent electrical characteristic of the low band in 470 MHz to 770 MHz. The reason why it is possible to improve the electrical characteristic by the provision of such side sections 21*b* is believed to be that, thanks to the provision of the side sections 21*b*, the separation (α2: see FIG. 9) of the side edge of the radiator 20 and the leading edge of the side sections 21*b* can be made small while maintaining the separation D2 of the radiator 20 and reflector 21. Also, the gain can be guaranteed in a wide frequency band of 470 MHz to 770 MHz, by employing a large width W12 of the upper side 20*d* and lower side 20*e*. While the electrical characteristic tends to deteriorate as the separation D2 of the radiator 20 and the reflector 21 is decreased, a fully satisfactory electrical characteristic for a planar antenna 2 fitted with a reflector can be obtained if the separation D2 between the radiator 20 and the reflector 21 is made about 30 mm.

The wavelength λc at the central frequency is about 484 mm, if the UHF band used to operate the planar antenna 2 fitted with a reflector according to the present invention is 470 to 770 MHz. The length of the outer periphery of the first triangular loop element and the second triangular loop element of the planar antenna 2 fitted with a reflector according to the present invention is about 0.9 λa for a wavelength λa of 470 MHz and the length of the inner periphery is about 1.02 λb for wavelength 770 MHz. Thus the length of the outer periphery of the triangular double loop element (radiator 20) of the planar antenna 2 fitted with a reflector is substantially the wavelength λa of the lower limiting frequency of the frequency band that is employed and the length of the inner periphery thereof is substantially the wavelength λb of the upper limiting frequency of the frequency band that is employed. Also, even if the height H12 of the reflector 21 is 0.86 H11 to 1.15 H11 of the height H11 of the radiator 20, an excellent electrical characteristic can be maintained. Furthermore, the separation D2 of the radiator 20 and the reflector 21 can be reduced to about 0.06 λc and the separation α2 of the side edges of the radiator 20 and the leading edges of the side sections 21*b* can be made less than the separation D2, and the electrical characteristic of the planar antenna 2 fitted with a reflector is improved as the separation α2 is made smaller.

Figure 12:
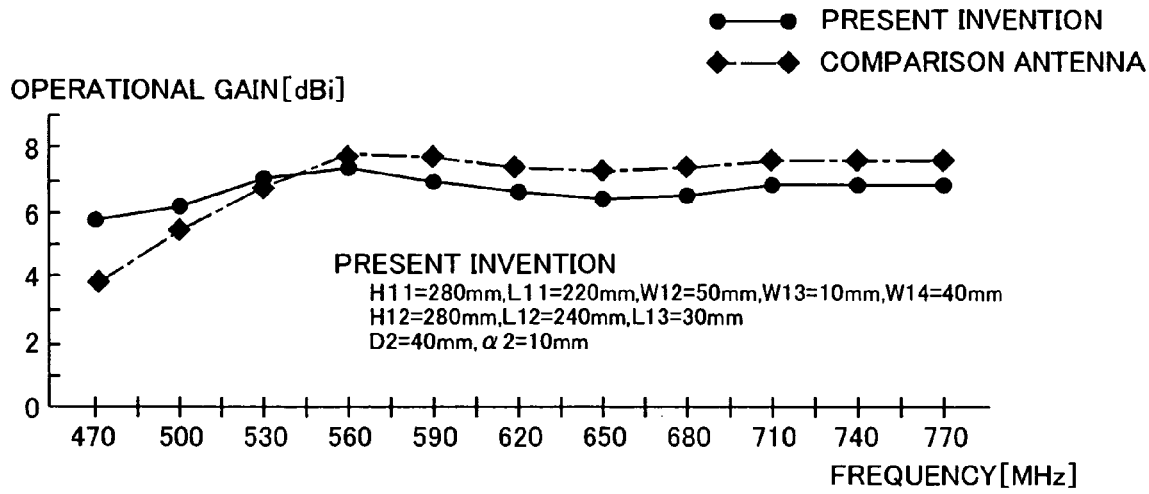
FIG. 12 is a view showing the frequency characteristic of the operational gain in the construction of embodiment 2 of a planar antenna fitted with a reflector according to the present invention when the parameters thereof are changed, compared with a comparison antenna.
Figure 13:
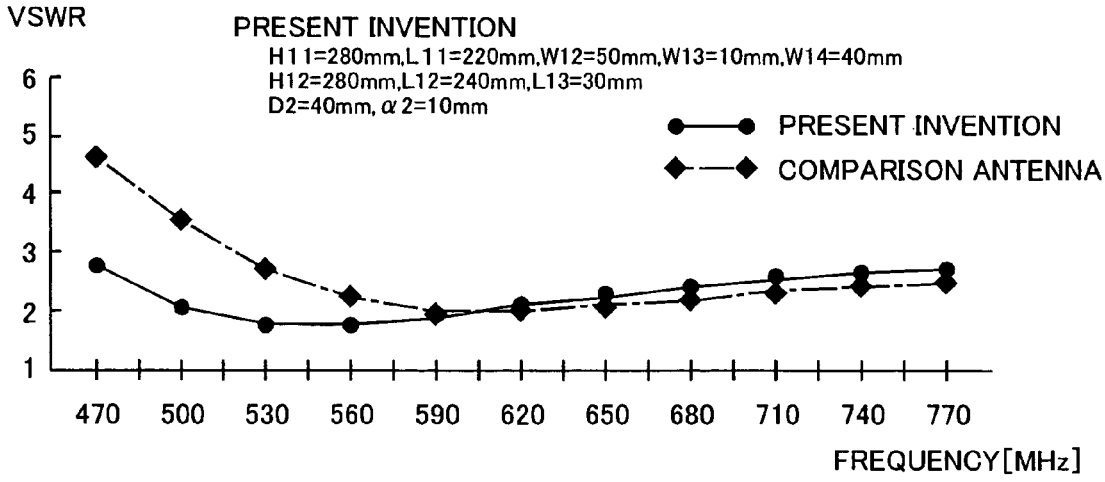
FIG. 13 is a view showing the frequency characteristic of the VSWR in the construction of embodiment 2 of a planar antenna fitted with a reflector according to the present invention when the parameters thereof are changed, compared with a comparison antenna.

Next, FIG. 12 and FIG. 13 show the frequency characteristics of the operating gain and VSWR measured after altering the width L13 of the side sections 21*b* of the reflector 21 in the planar antenna 2 fitted with a reflector according to the present invention to about 0.06 λc (where λc is the wavelength of the central frequency of the frequency band that is used), together with the operating gain and VSWR of the comparison antenna shown in FIG. 18.

By referring to FIG. 12 and FIG. 13, it can be seen that, if the width of the side sections 21*b* is shorter than about 10 mm, as shown by the black circles, the electrical characteristic of the planar antenna 2 fitted with a reflector according to the present invention is somewhat degraded in the lower region of the 470 MHz to 770 MHz band, which is the terrestrial digital broadcast frequency band, a fully satisfactory electrical characteristic can still be obtained. The transverse width of the comparison antenna was taken as 300 mm, which is the width when the reflector 21 is not folded; its electrical characteristic in the low band is inferior to that of the planar antenna 2 fitted with a reflector according to the present invention.

Figure 14:
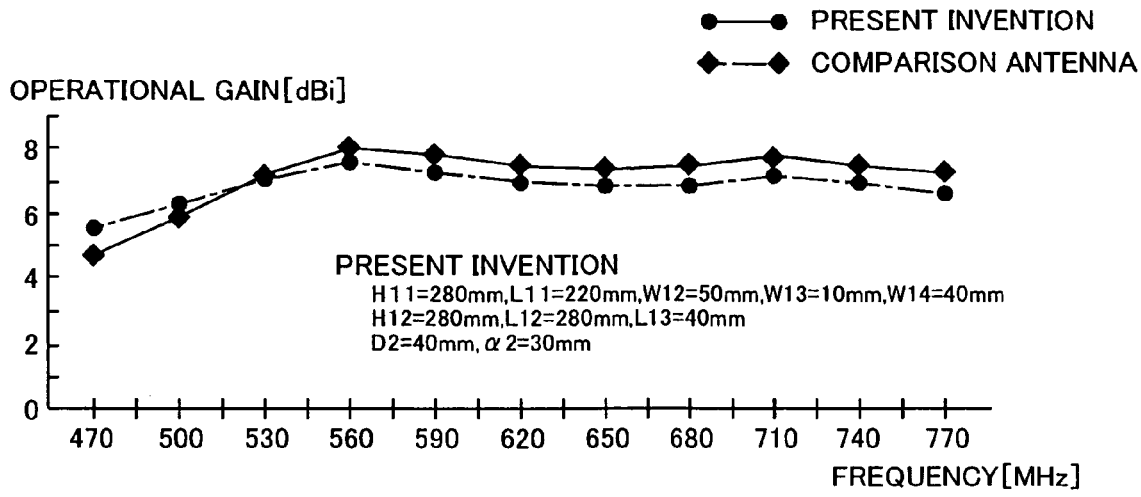
FIG. 14 is a view showing the frequency characteristic of the operational gain in the construction of embodiment 2 of a planar antenna fitted with a reflector according to the present invention when the parameters thereof are changed, compared with a comparison antenna.
Figure 15:
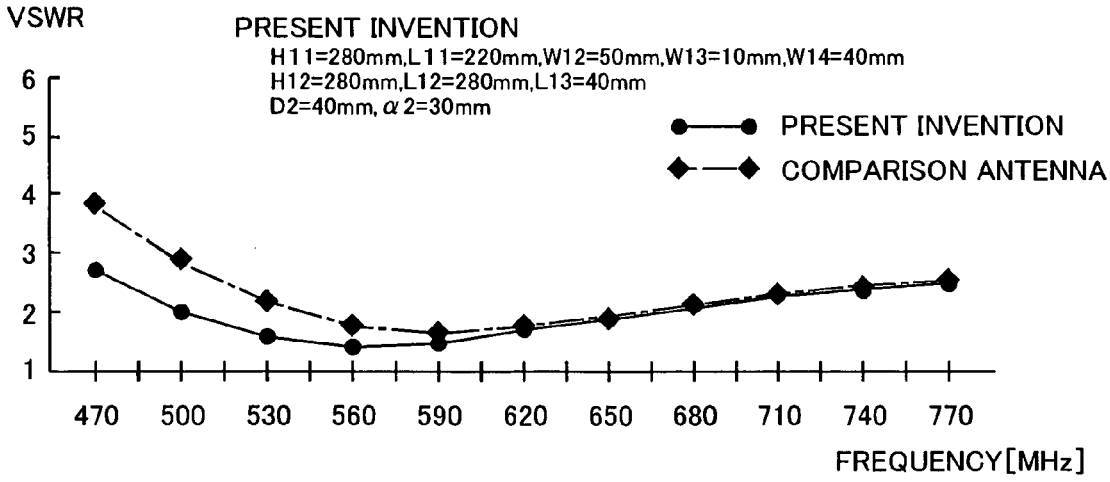
FIG. 15 is a view showing the frequency characteristic of the VSWR in the construction of embodiment 2 of a planar antenna fitted with a reflector according to the present invention when the parameters thereof are changed, compared with a comparison antenna.

Next, FIG. 14 and FIG. 15 show the frequency characteristics of the operating gain and VSWR measured after returning the width L13 to about 0.08 λc and altering the separation α2 of the side edges of the radiator 20 and the side sections 21*b* of the reflector 21 to about 0.06 λc (30 mm), together with the operating gain and VSWR of the comparison antenna shown in FIG. 18.

By referring to FIG. 14 and FIG. 15, it can be seen that, as shown by the black circles, if the separation α2 is increased, the electrical characteristic of the planar antenna 2 fitted with a reflector according to the present invention is somewhat degraded in the lower region of the 470 MHz to 770 MHz band, which is the terrestrial digital broadcast frequency band, but a fully satisfactory electrical characteristic can still be obtained. The transverse width of the comparison antenna was taken as 320 mm, which is the width when the reflector 21 is not folded; its electrical characteristic in the low band is inferior to that of the planar antenna 2 fitted with a reflector according to the present invention.

Figure 16:
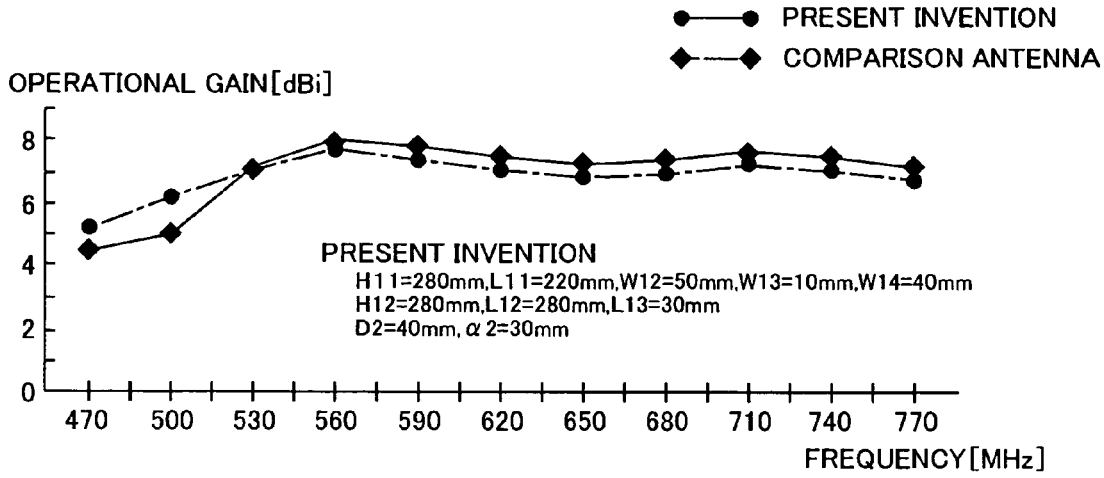
FIG. 16 is a view showing the frequency characteristic of the operational gain in the construction of embodiment 2 of a planar antenna fitted with a reflector according to the present invention when the parameters thereof are changed, compared with a comparison antenna.
Figure 17:
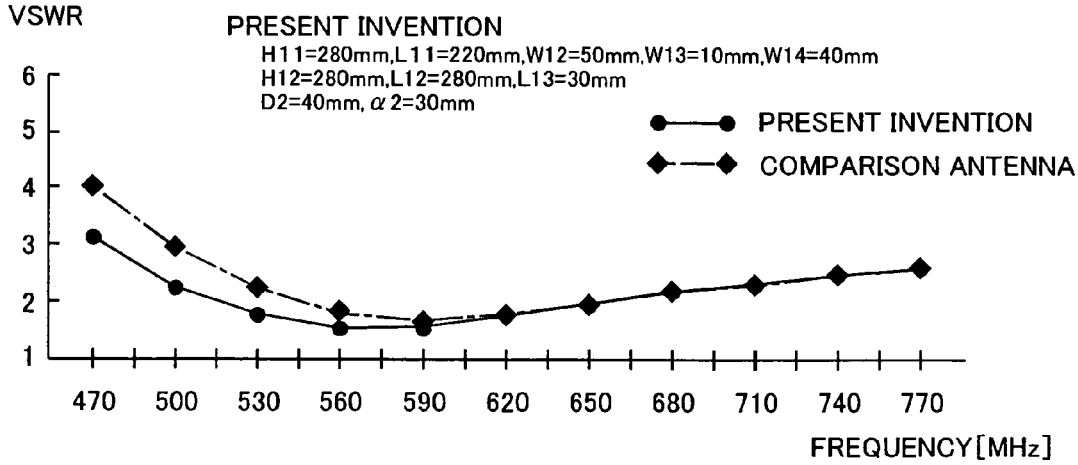
FIG. 17 is a view showing the frequency characteristic of the VSWR in the construction of embodiment 2 of a planar antenna fitted with a reflector according to the present invention when the parameters thereof are changed, compared with a comparison antenna.

Next, FIG. 16 and FIG. 17 show the frequency characteristics of the operating gain and VSWR measured after altering the width L13 of the side sections 21*b* of the reflector 21 in the planar antenna 2 fitted with a reflector according to the present invention to about 0.06 λc, and altering the separation α2 of the side edges of the radiator 20 and the side sections 21*b* of the reflector 21 to about 0.06 λc, together with the operating gain and VSWR of the comparison antenna shown in FIG. 18.

By referring to FIG. 17 and FIG. 18, it can be seen that, if the width of the side sections 21*b* is shorter than about 10 mm, as shown by the black circles, if the separation α2 is increased, the electrical characteristic of the planar antenna 2 fitted with a reflector according to the present invention is somewhat further degraded in the lower region of the 470 MHz to 770 MHz band, which is the terrestrial digital broadcast frequency band, but a fully satisfactory electrical characteristic can still be obtained. The transverse width of the comparison antenna was taken as 300 mm, which is the width when the reflector 21 is not folded; its electrical characteristic in the low band is inferior to that of the planar antenna 2 fitted with a reflector according to the present invention.

Next, FIG. 19 shows in tabular form the degree of improvement of the electrical characteristic (VSWR) when the separation D2 of the radiator 20 and reflector 21 in the planar antenna 2 fitted with a reflector according to the present invention, the width L13 of the side sections 21*b* of the reflector 21 and the separation between the side edges of the radiator 20 and the side sections 21*b* in the reflector 21 are altered, taking α2 as a parameter.

Referring to FIG. 19, the degree of improvement of the electrical characteristic is lowered as the separation α2 of the side edges of the radiator 20 and the side sections 21*b* in the reflector 21 is increased. Also, the degree of improvement of the electrical characteristic is lowered as the width L13 of the side sections 21*b* of the reflector 21 is increased. Furthermore, the frequency range of improvement is reduced as the separation D2 of the radiator 20 and the reflector 21 is increased.

In the planar antenna fitted with a reflector according to the present invention as described above, the antennas employed were the rectangular double loop antenna such as the radiator 10 shown in embodiment 1 or the triangular double loop element such as the radiator 20 shown in embodiment 2. However, the planar antenna fitted with a reflector according to the present invention is not restricted to such radiators and radiators of various constructions could be employed. FIG. 20 to FIG. 23 show examples of the construction of radiators capable of use as the planar antenna fitted with a reflector according to the present invention.

Figure 20:
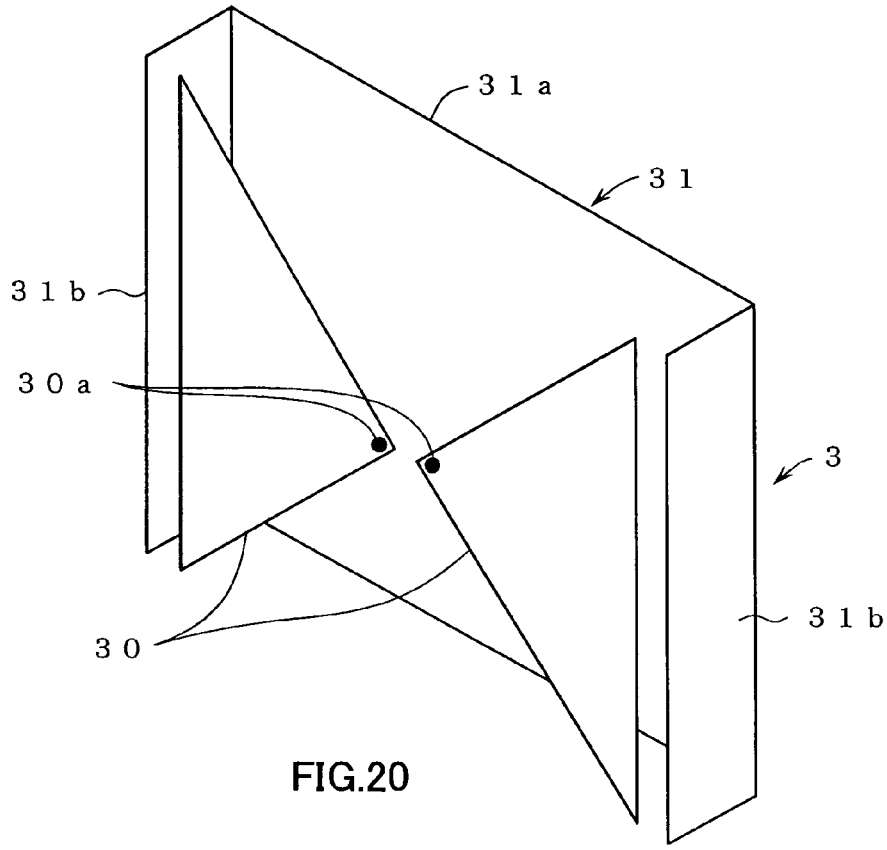
FIG. 20 is a perspective view showing a construction using a biconical radiator as a radiator in a planar antenna fitted with a reflector according to the present invention.

FIG. 20 shows a perspective view illustrating a construction in which a biconical radiator is employed as the radiator in a planar antenna fitted with a reflector according to the present invention.

The planar antenna 3 fitted with a reflector according to the embodiment of the present invention shown in this Figure comprises a biconical radiator 30 and a reflector 31 arranged to the rear of and facing the biconical radiator 30. The biconical radiator 30 is constructed in the form of two triangular plates produced by processing metallic sheet and, as shown in FIG. 20, is arranged such that the vertices of the two triangular plate shaped elements face each other in a parallel plane. The vertices of the respective facing elements are employed as power feed points 30*a*. The reflector 31 is formed by bending both sides of a rectangular metallic sheet substantially at right angles so as to face each other; as shown in FIG. 20, it comprises a front face section 31*a* facing the surface of the biconical radiator 30 and side sections 31*b* formed by bending both sides of the front face section 31*a* towards the biconical radiator 30. Also, the height of the reflector 31 is made substantially the same as the height of the triangular plate shaped biconical radiator 30.

In this planar antenna 3 fitted with a reflector also, since both sides in the reflector 31 are bent towards the biconical radiator 30, taking the wavelength at the central frequency of the UHF band as λc, the separation of the biconical radiator 30 and the reflector 31 can be reduced to about 0.06 λc. Also, the separation of the side edges of the biconical radiator 30 and the leading edges of the side sections 31*b* can be reduced to no more than about 0.06 λc. Thus, also in the case of the planar antenna 3 fitted with a reflector employed in this biconical radiator 30, a planar antenna fitted with a reflector of small size and small depth can be obtained and an antenna that functions fully satisfactorily in the UHF band i.e. the terrestrial digital broadcast frequency band can thereby be achieved.

Figure 21:
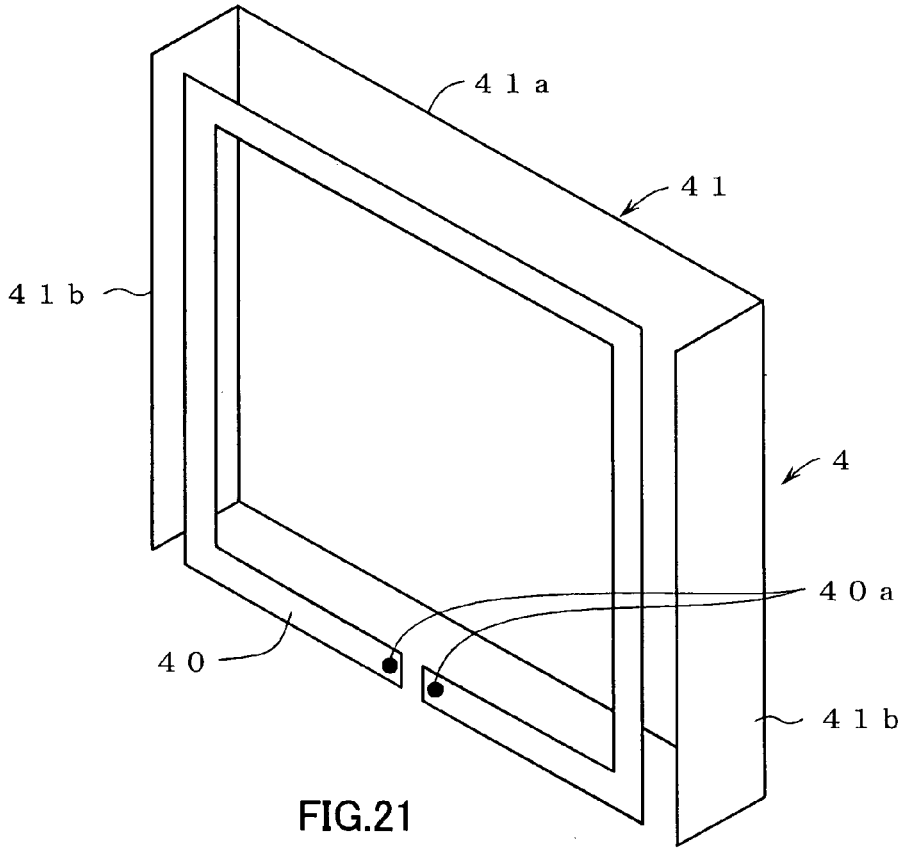
FIG. 21 is a perspective view showing a construction using a loop radiator as a radiator in a planar antenna fitted with a reflector according to the present invention.

Next, FIG. 21 shows a perspective view of a construction in which a loop radiator is employed as the radiator in a planar antenna fitted with a reflector according to the present invention.

The planar antenna 4 fitted with a reflector according to the embodiment of the present invention illustrated in this Figure comprises a loop radiator 40 and a reflector 41 arranged to the rear of and facing the loop radiator 40. The loop radiator 40 is constructed by processing a metallic sheet into a single-turn rectangular loop shape; as shown in FIG. 21, the coil starting end and coil termination end of the rectangular loop shape are employed as power feed points 40*a*. The reflector 41 is formed by bending both sides of the rectangular metallic sheet substantially at right-angles so as to face each other; as shown in FIG. 21, it comprises a front face section 41*a* facing the surface of the loop radiator 40 and side sections 41*b* formed by bending towards the loop radiator 40 at both sides of the front face section 41*a*. Also, the height of the reflector 41 is made substantially the same as the height of the rectangular loop radiator 40.

Thus, also in the case of this planar antenna 4 fitted with a reflector, since both side sections in the reflector 41 are bent towards the loop radiator 40, the separation of the loop radiator 40 and reflector 41 can be reduced to about 0.06 λc, where λc is the wavelength at the central frequency of the UHF band. Also, the separation between the side edges of the loop radiator 40 and the leading edges of the side sections 41*b* can be made about 0.06 λc or less. Thus, also in the case of this planar antenna 4 fitted with a reflector using a loop radiator 40, a planar antenna fitted with a reflector of small size and small depth can be obtained and an antenna that functions fully satisfactorily in the UHF band i.e. the terrestrial digital broadcast frequency band can thereby be achieved. The loop radiator 40 could be a loop radiator of circular or elliptical shape.

Figure 22:
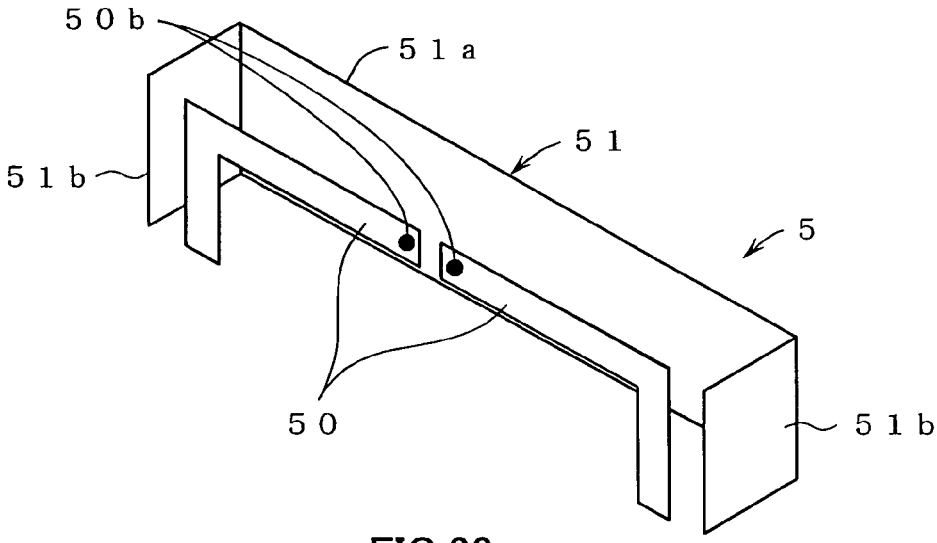
FIG. 22 is a perspective view showing a construction using a dipole radiator as a radiator in a planar antenna fitted with a reflector according to the present invention.

Next, FIG. 22 shows a perspective view illustrating the construction when a dipole radiator is employed as the radiator in a planar antenna fitted with a reflector according to the present invention.

The planar antenna 5 fitted with a reflector according to the embodiment of the present invention shown in this Figure comprises a dipole radiator 50 and a reflector 51 arranged to the rear of and facing the dipole radiator 50. The dipole radiator 50 is constructed by processing a metallic sheet so as to bend both ends thereof substantially at right-angles and, as shown FIG. 22, the central section thereof is employed as a power feed point 50*a*. The reflector 51 is formed by bending both sides of a rectangular metallic sheet substantially at right angles so as to face each other and, as shown in FIG. 22, comprises a front face section 51*a* facing the surface of the dipole radiator 50 whereof both ends are bent and side sections 51*b* formed by bending both sides of the front face section 51*a* towards the dipole radiator 50. Also, the height of the reflector 51 is made substantially the same height as the height of the dipole radiator 50 whereof both ends are bent.

With this planar antenna 5 fitted with a reflector also, thanks to the bending of the two side sections in the reflector 51 towards the dipole radiator 50, the separation of the dipole radiator 50 and the reflector 51 can be reduced to about 0.06 λc, where λc is the wavelength of the central frequency of the UHF band. Also, the separation of the side edges of the dipole radiator 50 and the leading edges of the side sections 51*b* can be reduced to about 0.06 λc or less. In this way, with the planar antenna 5 fitted with a reflector employing a dipole radiator 50 also, a planar antenna fitted with a reflector of small depth and small size can be achieved and an antenna with fully satisfactory operation in the UHF band i.e. terrestrial digital broadcast frequency band can be obtained. The dipole element 50 could be bent upwards or bent downwards.

Figure 23:
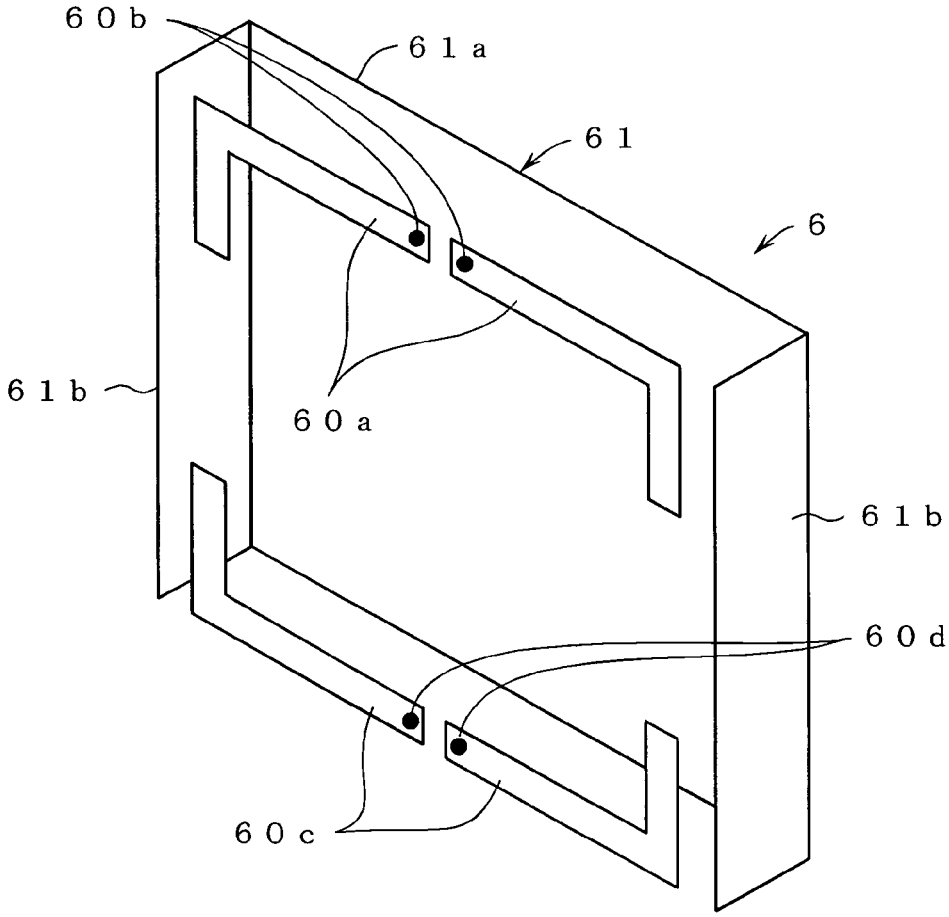
FIG. 23 is a perspective view showing a construction using a stacked dipole radiator as a radiator in a planar antenna fitted with a reflector according to the present invention.

Next, FIG. 23 shows a perspective view illustrating a construction in which a stacked dipole radiator is employed as the radiator in a planar antenna fitted with a reflector according to the present invention.

The planar antenna 6 fitted with a reflector according to the embodiment of the present invention illustrated in this Figure comprises a radiator constituted by a first dipole radiator 60*a* and a second dipole radiator 60*c* stacked on two levels, and a reflector 61 arranged to the rear of and facing the stacked dipole radiators 60*a*, 60*c*. The dipole radiators 60*a*, 60*c* are constructed by processing respective metallic sheets so that both ends thereof are bent substantially at right angles so as to face each other; as shown in FIG. 23, the central sections thereof are employed as power feed points 60*b*, 60*d*. The reflector 61 is formed by bending both ends of a rectangular metallic sheet substantially at right angles so as to face each other; as shown in FIG. 23, it comprises a front face section 61*a* facing the surface of the dipole radiators 60*a*, 60*c* whereof both ends are bent and side sections 61*b* formed by bending towards the dipole radiator 60 at both sides of the front face section 61*a*. Also, the height of the reflector 61 is made to be substantially the same height as the height of the stacked dipole radiators 60*a*, 60*c* whereof both ends are bent.

Thus, also in the case of this planar antenna 6 fitted with a reflector, since both side sections in the reflector 61 are bent towards stacked dipole radiators 60*a*, 60*c*, the separation of the stacked dipole radiators 60*a*, 60*c* and the reflector 61 can be reduced to about 0.06 λc, where λc is the wavelength at the central frequency of the UHF band. Also, the separation between the side edges of the stacked dipole radiators 60*a*, 60*c* and the leading edges of the side sections 61*b* can be made about 0.06 λc or less. Thus, also in the case of this planar antenna 6 fitted with a reflector using stacked dipole radiators 60*a*, 60*c*, a planar antenna fitted with a reflector of small size and small depth can be obtained and an antenna that functions fully satisfactorily in the UHF band i.e. the terrestrial digital broadcast frequency band can thereby be achieved. It should be noted that a planar antenna 6 of small size fitted with a reflector wherein the first dipole radiator 60*a* is bent downwards and the second dipole radiator 60*c* is bent upwards could be employed. Also, the number of levels of stacked dipole radiators could be three or more levels.

FIG. 24 to FIG. 29 show further constructional examples of a reflector in a planar antenna fitted with a reflector according to the present invention as described above.

Figure 24:
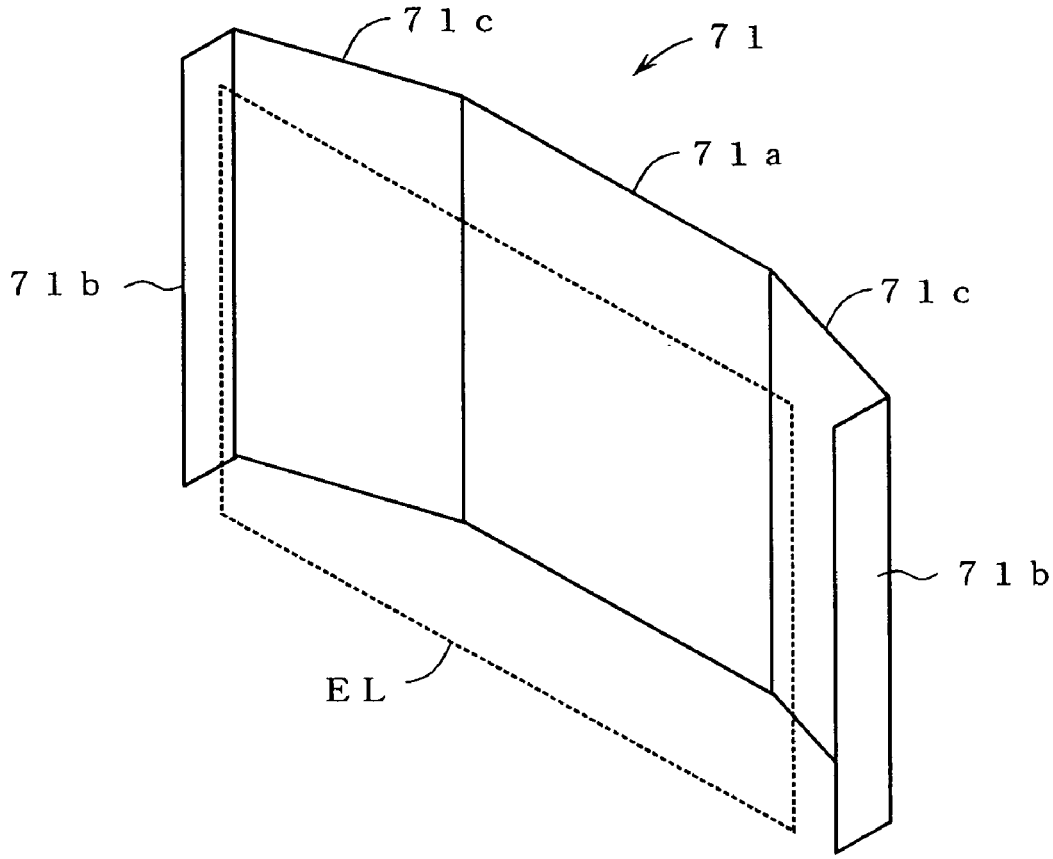
FIG. 24 is a perspective view showing a first construction according to another example construction of a reflector in a planar antenna fitted with a reflector according to the present invention.
Figure 25:
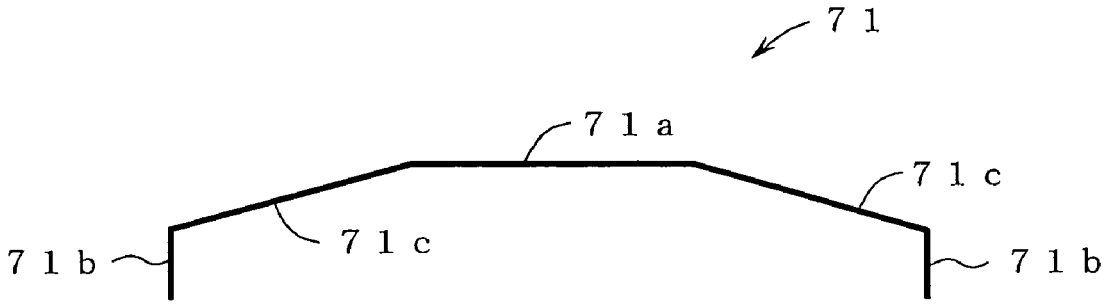
FIG. 25 is a top view showing a first construction according to another example construction of a reflector in a planar antenna fitted with a reflector according to the present invention.

FIG. 24 shows a perspective view illustrating a first construction of a further constructional example of a reflector and FIG. 25 shows a top view illustrating this construction.

The reflector 71 shown in FIG. 24 and FIG. 25 is constructed by processing the metallic sheet to a substantially rectangular shape and is formed with a front face section 71*a* facing a radiator EL and bent sections 71*c* that are bent at obtuse angles on both sides of the front face section 71*a*, towards the radiator EL. The leading edges of the bent sections 71*c* are respectively formed with side sections 71*b* that are bent substantially at right angles with respect to the front face section 71*a*. For the radiator EL, any of the radiators described above may be employed. In this planar antenna fitted with a reflector comprising a reflector 71 and radiator EL also, since the side sections 71*b* of both sides in the reflector 71 are bent towards the radiator EL, taking the wavelength at the central frequency of the UHF band as λc, the separation of the radiator EL and the reflector 71 can be reduced to about 0.06 λc. Also, the separation of the side edges of the radiator EL and the leading edges of the side sections 71*b* can be reduced to no more than about 0.06 λc. Thus, a planar antenna fitted with a reflector of small size and small depth can be obtained and an antenna that functions fully satisfactorily in the UHF band i.e. the terrestrial digital broadcast frequency band can thereby be achieved.

Figure 26:
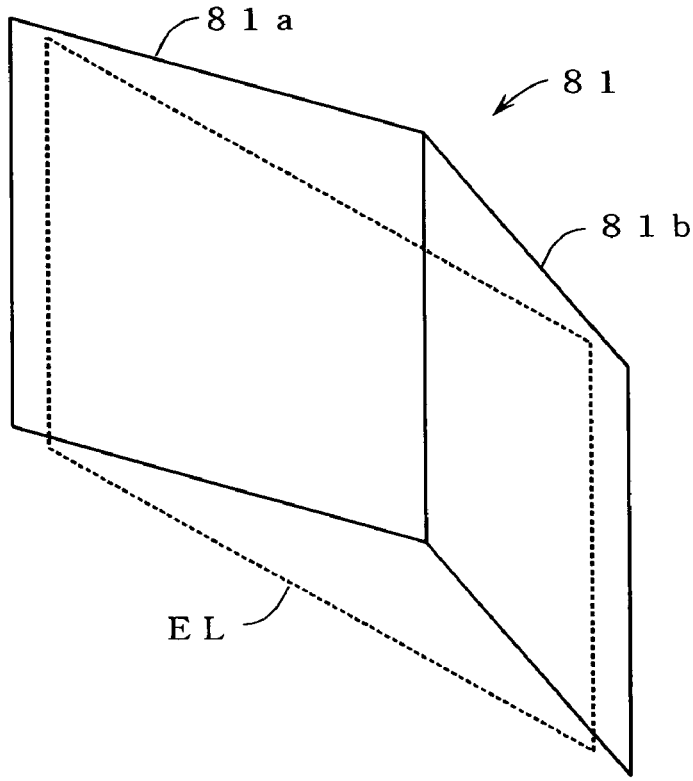
FIG. 26 is a perspective view showing a second construction according to another example construction of a reflector in a planar antenna fitted with a reflector according to the present invention.
Figure 27:
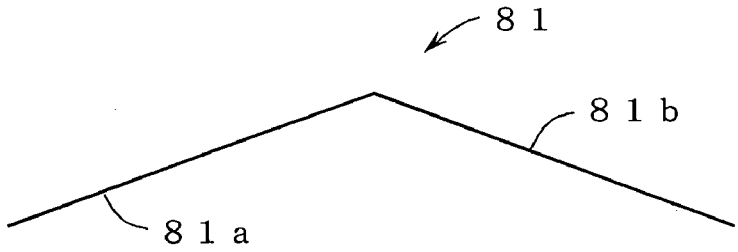
FIG. 27 is a top view showing a second construction according to yet another example construction of a reflector in a planar antenna fitted with a reflector according to the present invention.

Next, FIG. 26 shows a perspective view illustrating a second construction of a further constructional example of a reflector and FIG. 27 shows a top view illustrating the construction thereof.

The reflector 81 shown in FIG. 26 and FIG. 27 is constructed by processing a metallic sheet to rectangular shape and, as shown in FIG. 27, its cross-section is formed in triangular shape by bending at substantially the middle thereof with an obtuse angle. Thus, the reflector 81 comprises a first bent section 81*a* and a second bent section 82*b* and a radiator EL is arranged facing the reflector 81. In this case, the end edges of the first bend section 81*a* and second bent section 82*b* are arranged so as to be adjacent to the radiator EL. The radiator EL may be any of the radiators described above. With a planar antenna fitted with a reflector comprising such a reflector 81 and radiator EL, with the end edges of the first bent section 81*a* and second bent section 82*b* in the reflector 81 being arranged adjacent to the radiator EL, taking the wavelength at the central frequency of the UHF band as λc, the separation between the side edges of the radiator EL and the end edges of the first bent section 81*a* and second bent section 82*b* can be reduced to no more than about 0.06 λc. Thus, a planar antenna fitted with a reflector of small size and small depth can be obtained and an antenna that functions fully satisfactorily in the UHF band i.e. the terrestrial digital broadcast frequency band can thereby be achieved.

Figure 28:
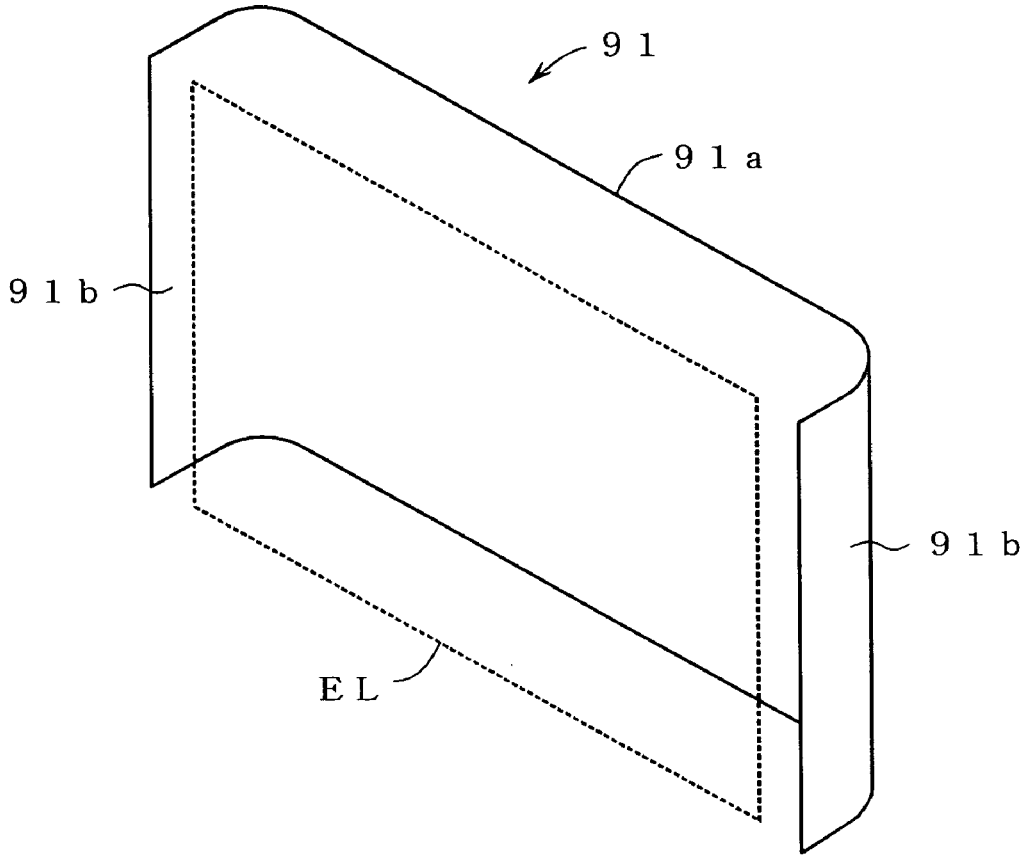
FIG. 28 is a perspective view showing a third construction according to yet another example construction of a reflector in a planar antenna fitted with a reflector according to the present invention.
Figure 29:
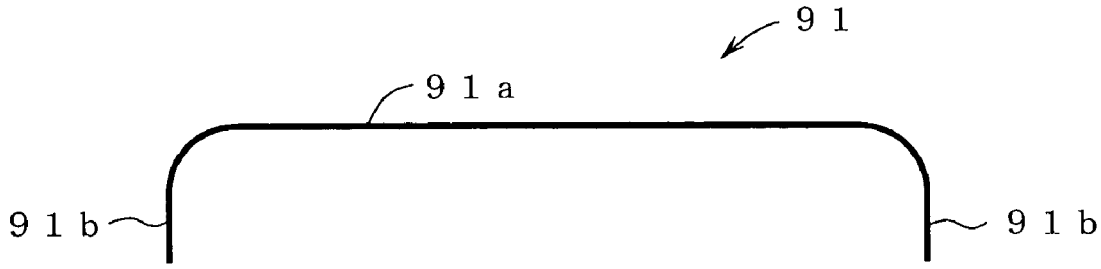
FIG. 29 is a top view showing a third construction according to yet another example construction of a reflector in a planar antenna fitted with a reflector according to the present invention.

FIG. 28 shows a perspective view illustrating a third construction according to another constructional example of a reflector; FIG. 29 shows a top view illustrating this construction.

The reflector 91 shown in FIG. 28 in FIG. 29 is constructed by processing a metallic sheet to substantially rectangular shape and is respectively formed with an upper face section 91*a* facing the radiator EL and side sections 91*b* that are bent substantially orthogonally, with rounded portions (radiussed sections) attached on both sides of the front face section 91*a*. The radiator EL may be any of the radiators described above. With the planar antenna fitted with a reflector comprising such a reflector 91 and radiator EL also, since the side sections 91*b* on both sides in the reflector 91 are bent towards the radiator EL, the separation of the radiator EL and the reflector 91 can be reduced to about 0.06 λc, where λc is the wavelength of the central frequency of the UHF band. Also, the separation of the side edges of the radiator EL and the leading edges of the side sections 91*b* can be reduced to no more than about 0.06 λc. Thus, a planar antenna fitted with a reflector of small size and small depth can be obtained and an antenna that functions fully satisfactorily in the UHF band i.e. the terrestrial digital broadcast frequency band can thereby be achieved.

Although, in the planar antenna fitted with a reflector according to embodiment 1 and embodiment 2 of the present invention as described above, the width of the upper and lower sides is formed to be wider than that of the other sides, there is no restriction to this and all of the sides could be formed with large width. Also, although the dimensions of the planar antenna fitted with a reflector according to embodiment 1 and embodiment 2 of the present invention were illustrated, these dimensions or range of dimensions are merely given by way of example and there is no restriction to these; fully satisfactory antenna operation can be achieved even with dimensions departing to some degree from these. However, the electrical characteristic may be somewhat degraded. The most important characteristic of the present invention is that the two side sections in the reflector are bent towards the radiator; the dimensions of the various sections are not important characteristics.

Also, although the radiator of the planar antenna fitted with a reflector according to the present invention shown in FIG. 20 to FIG. 23 was of plate shaped construction, there is no restriction to this and a radiator of rod-like construction could be employed.

INDUSTRIAL APPLICABILITY

Although the above description related to a planar antenna fitted with a reflector that receives terrestrial digital broadcasts, the present invention is not restricted to this and could be applied to a planar antenna fitted with a reflector that transmits and receives the UHF band.

The invention claimed is:

1. A planar antenna fitted with a reflector comprising: a radiator; and a reflector of planar form whereof both side sections, arranged to the rear of and facing towards said radiator with only a prescribed separation (D), are bent towards said radiator, where λ is the wavelength of the central frequency of the operating frequency band, characterized in that said prescribed separation (D) of said radiator and said reflector has a range from about 0.06λ to 0.15λ, and the separation between the leading edges of two side sections in said reflector and said radiator is not greater than 0.06λ.

2. The planar antenna fitted with a reflector of claim 1, characterized in that said radiator is selected from the group consisting of a dipole, stacked dipole, biconical, loop, triangular double loop and rectangular double loop.

3. The planar antenna fitted with a reflector of claim 1, characterized in that said reflector is formed whereof a front face section facing towards said radiator, and bent sections thereof are bent an obtuse angle at the two side sections of said front face section is arranged to face towards said radiator, the two side edges thereof are bent to cross almost rectangularly against said front face section of the leading edge of said bent sections are arranged.

4. A planar antenna fitted with a reflector comprising: a radiator of planar form which has at least upper and lower sides and comprises a double loop element wherein the width of said upper and lower sides is formed wider than that of the other sides thereof; and a reflector of planar form whereof both side sections, arranged to the rear of and facing towards said radiator with only a prescribed separation (D), are bent towards said radiator, where λ is the wavelength of the central frequency of the operating frequency band, characterized in that said prescribed separation (D) of said radiator and said reflector has a range from about 0.06λ to 0.15λ, and the separation between the leading edges of two side sections in said reflector and said radiator is not greater than 0.06λ.

5. The planar antenna fitted with a reflector of claim 4, characterized in that said radiator comprises a triangular double loop element or rectangular double loop element, the width of the upper and lower sides of said radiator being about 0.06 λ to 0.1λ.

6. The planar antenna fitted with a reflector of claim 4, characterized in that said reflector is formed whereof a front face section facing towards said radiator, and bent sections thereof are bent an obtuse angle at the two side sections of said front face section is arranged to face towards said radiator, the two side edges thereof are bent to cross almost rectangularly against said front face section of the leading edge of said bent sections are arranged.

7. A planar antenna fitted with a reflector comprising: a radiator; and a reflector of planar form whereof both side sections of a rectangular metallic plate are bent substantially at right-angles towards the radiator, arranged to the rear of and facing towards said radiator with only a prescribed separation (D), are bent towards said radiator, where λ is the wavelength of the central frequency of the operating frequency band, characterized in that said prescribed separation (D) of said radiator and said reflector has a range from about 0.06 λ to 0.15λ, and the separation between the leading edges of two side sections in said reflector and said radiator is not greater than 0.06λ.

8. The planar antenna fitted with a reflector of claim 7, characterized in that said radiator is selected from the group consisting of a dipole, stacked dipole, biconical, loop, triangular double loop and rectangular double loop.

9. The planar antenna fitted with a reflector of claim 7, characterized in that said reflector is formed whereof a front face section facing towards said radiator, and bent sections thereof are bent an obtuse angle at the two side sections of said front face section is arranged to face towards said radiator, the two side edges thereof are bent to cross almost rectangularly against said front face section of the leading edge of said bent sections are arranged.

10. The planar antenna fitted with a reflector of claim 7, where the radiator is of planar form, has at least upper and lower sides and comprises a double loop element, wherein the width of said upper and lower sides is formed wider than that of the other sides thereof.

11. The planar antenna fitted with a reflector of claim 10, characterized in that said radiator comprises a triangular double loop element or rectangular double loop element, the width of the upper and lower sides of said radiator being about 0.06λ to 0.1λ.

12. The planar antenna fitted with a reflector of claim 10, characterized in that said reflector is formed whereof a front face section facing towards said radiator, and bent sections thereof are bent an obtuse angle at the two side sections of said front face section is arranged to face towards said radiator, the two side edges thereof are bent to cross almost rectangularly against said front face section of the leading edge of said bent sections are arranged.

* * * * *